United States Patent [19]

Elkins et al.

[11] 4,303,201

[45] Dec. 1, 1981

[54] SHOWERING SYSTEM

[75] Inventors: Christopher W. Elkins; David W. Smith; John Trenary, all of Ft. Collins, Colo.

[73] Assignee: Teledyne Industries, Inc., Ft. Collins, Colo.

[21] Appl. No.: 109,882

[22] Filed: Jan. 7, 1980

[51] Int. Cl.[3] ..... A61H 33/06; B05B 1/08; B05B 1/30

[52] U.S. Cl. ..... 239/383; 4/524; 4/535; 4/596; 239/391; 239/447

[58] Field of Search ..... 4/524, 525, 533, 535, 4/536, 537, 567, 596, 597, 601, 615; 239/101, 102, 289, 380, 381–383, 390, 391, 443–449

[56] References Cited

U.S. PATENT DOCUMENTS

| | | | |
|---|---|---|---|
| 3,557,389 | 1/1971 | Scobey | 4/524 |
| 3,958,756 | 5/1976 | Trenary et al. | 239/383 X |
| 4,084,271 | 4/1978 | Ginsberg | 4/524 |

FOREIGN PATENT DOCUMENTS 546747 7/1942 United Kingdom .

*Primary Examiner*—Andres Kashnikow
*Attorney, Agent, or Firm*—Hugh H. Drake

[57] ABSTRACT

A showering system includes a source of hot water and a showerhead fed from that source. To produce steam, there is a conduit that delivers water from the source to a showerhead and in which is defined an outlet. Disposed within the conduit is a selectively controlled diverter of the water arriving from the source, so as to direct it away from the showerhead and through the outlet in the form of a mist. The preferred showerhead is of a turbine-valve kind in which the turbine is driven by nozzles. Apertures in a flow director plate, governed by a control plate, feed nozzles predetermined to vary the force of water delivered from outlet orifices in correspondence with the number of the nozzles open to communicate with the inlet through the apertures.

57 Claims, 19 Drawing Figures

SHOWERING SYSTEM

The present invention pertains to a showering system. More particularly, it relates to a steam producing apparatus associated with a showerhead perferably of a kind which enables variation in the force of pulses of water delivered to a user.

Showerheads that deliver a pulsating spray have found widespread acceptance by the public. Those produced in accordance with the teachings of commonly-assigned U.S. Pat. Nos. 3,762,648, 3,801,019 and 3,958,756 have enjoyed outstanding success. In total, they enable the user to select a pulsating spray, a continuous spray or a combination of the two. The frequency of pulsation also is adjustable. The showerhead disclosed in co-pending application Ser. No. 794,958, filed May 9, 1977 and assigned to the same assignee as the present application, offers the further feature of permitting a coordinated adjustment of the force of the pulses as perceived by the user. That application also discloses apparatus for providing a still additional spray mode of an extremely soft character. A control mechanism is provided to allow the user to select as between different modes of operation, including either one of the two different continuous spray patterns or the pulsating patterns, as well as to adjust frequency of pulsation. A separate control enables the user to select the force of pulsation.

Most users of showerheads have experienced conditions in which a certain amount of steam or water vapor is produced by action of the shower. Indeed, the user often will activate a ventilation system in order to reduce the collection of condensation on nearby mirrors and other surfaces. That is, the steam or vapor which is produced is considered to be a bother. There is insufficient steam produced to provide any kind of pleasing effect comparable to that available in a sauna especially constructed to afford a worthwhile result.

Sauna-type devices have heretofore been suggested for use in showerstalls and the like. To that end, a valve arrangement usually is supplied for the purpose of diverting hot water into a separate fixture, at least usually connected by a hose, which leads to a misting or atomizing device. To operate efficiently, such a device requires that the user adjust his faucets so as to supply only hot water. Should a rupture develop either in the connecting hose or in the diverting system, the user is in danger of being scalded by the water at the temperature selected to create the desired steam. Even absent a failure such as that, the user may similarly be scalded by exceedingly-hot water if he has the device installed in connection with a showerhead and forgets to lower the water temperature before he switches back to use of the showerhead.

Maximum enjoyment of a showering system may be found with a combination operation of a steam sauna and a massageaction showerhead. Alternating between the respective effects upon the skin of the steam and the pulsating action of the showerhead also upon the skin, the user may achieve a very favorable result. To achieve that end with an aggregation of prior apparatus, however, may endanger the user as above indicated as well as requiring the manipulation of several different controls.

One general object of the present invention is to provide a new and improved showering system that overcomes disadvantages of the aforenoted approaches.

Another general object of the present invention is to provide a new and improved showerhead which enables unicontrol of pulse perception along with adjustment of other waterdelivery characteristics.

A further object of the present invention is to provide new and improved apparatus for achieving such objectives with both safety and convenience.

A related object of the present invention is to provide apparatus for achieving the foregoing purposes and yet which is economical of manufacture and durable in use.

In accordance with one aspect of the present invention, a showering system includes a source of hot water and a showerhead fed from that source. A steam producer includes a conduit that delivers water from the source to the showerhead. An outlet is defined in the conduit. Means disposed in the conduit selectively diverts the water from the source away from the showerhead and through the outlet in the form of a mist.

In accordance with another aspect, there is a showerhead of a kind that includes an inlet, a series of circumferentially-spaced orifices, a turbine with a valve for sequentially opening successive ones of the orifices, a plurality of nozzles that drive the turbine, a multiplyapertured flow director plate for communicating water from the inlet to the nozzles, a control plate for selectively coupling water from the inlet to different ones of the apertures and a control for moving the control plate relative to the director plate. There are first and second ones of said nozzles associated with first and second apertures in the director plate. Shutters associated with the control plate selectively open the apertures in different combinations. The flow capacity of the nozzles are predetermined to vary the force of water delivered from the orifices in correspondence with the number of the nozzles opened to communicate with the inlet through the apertures.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
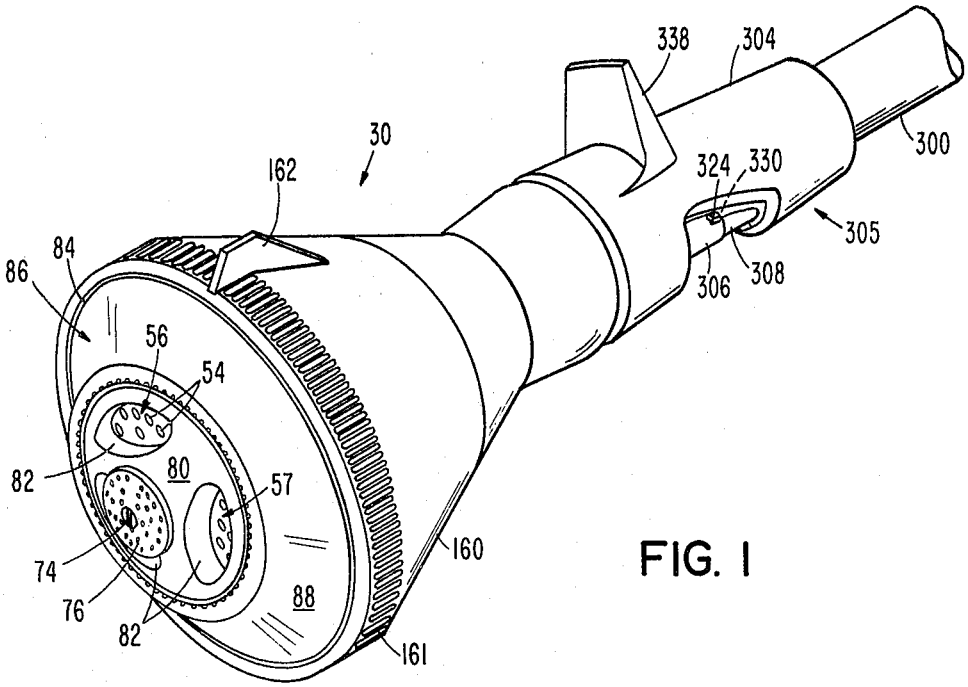
FIG. 1 is an isometric view of one embodiment of a showering system.

A showerhead 30 includes an annular housing 32 threaded at 34 to receive a somewhat cup-shaped connector 36 and sealed thereto by a gasket 38. Projecting outwardly and integrally from connector 36 is a tube 40 externally threaded on its outer end portion at 42. Seated within the forward end portion of housing 32 is an orifice cup 44 the outer perimeter of which rests upon a ledge 46 of housing 32 and which, upon assembly, is secured into appropriate orientational relationship by the seating of nonsymmetrically disposed lugs 48 in slots 50. Cup 44 defines an internal vortex chamber 52. Projecting forwardly from and through the bottom of cup 44 from chamber 52 are a plurality of orifices 54. Orifices 54 are arranged in three circumferentially-spaced groups 56, 57 and 58.

Defined around the interior of the forward portion of housing 32 are a series of circumferentially-spaced channels 60. Seated in a slot 62, formed around the periphery of cup 44, is one leg of a Z-shaped resilient seal 66 the opposite leg of which covers all of channels 60, so that the latter become a series of outlet spray orifices. Preferably, channels 60 alternate in inclination so as ultimately to result in the emission of two definable cones of spray having mutually-different divergent angles.

Projecting centrally through the forwardly facing wall of cup 44 is a tube 68. Centered within tube 68 is a spider 70 the legs of which hold a spindle 72. Threaded longitudinally within spindle 72 is a screw 74 that holds in place on its outer end a central orifice plate 76 through which extend a distributed array of emitter apertures 78. As will be observed hereinafter, water may be inletted into tube 68 in a continuous stream. Spider 70 serves to disperse that stream, so that it floods apertures 78. A cover or front cone 80 circumferentially spans the region between plate 76 and seal 66 for cosmetic purposes, while having openings 82 that circumscribe each of groups 56–58.

Surrounding the exterior of housing 32 are ring segments 84 clamped at their rear by the joinder of connector 36 to housing 32 and at their front formed into an annular band 86. A decal 88, secured on the forward face of band 86, carries printed information to be employed by the user in operation of the showerhead as indicated in the drawing.

Seated freely within cavity 52 is a turbine 90. It includes a plurality of radial blades 92 a portion of which project from a central semi-cylinder 94 which partially encircles the inner end of tube 68. A valve plate 96 defines a sector of an annulus having an extent, in this case, of approximately 216° that completes the encirclement of tube 68 and carries the remainder of blades 92.

Disposed on the inner surface of the forwardly-facing wall of chamber 52 are a series of lands 98 that correspond with groups 56–58 and are interconnected by ribs 100 so as to accommodate rotation of plate 96. The purpose of this arrangement is to enable turbine 90 to operate more satisfactorily under a condition of a low water throughput and as described and explained in more detail in co-pending application Ser. No. 913,284 filed June 7, 1978 now U.S. Pat. No. 4,190,207 issued Feb. 26, 1980.

Formed into the rearwardly-presented surface of cup 44 are a separated pair of arcuate troughs or plenums 110 and 112. Communicating from trough 110 into chamber 52 is a single nozzle 114 oriented to deliver water from that trough into driving action against blades 92 on turbine 90. Similarly oriented nozzles 116 and 118 extend inwardly from trough or plenum 112. Each of nozzles 114, 116 and 118 are cut into the side wall of the corresponding trough and extend from the top of the trough only a limited extent toward its bottom and the depth of the chamber. Water entering through the nozzles creates a forced vortex within chamber 52 that propels turbine 90 in the manner explained more fully in said application Ser. No. 913,284.

Seated adjacent to cup 44 and within housing 32 is a flow director 120. A resilient gasket 122 is disposed between the mating surfaces of cup 44 and director 120. The effectiveness of that seal is enhanced by the inclusion of seal directing ribs on the facing surface of director 120 that encircle the various apertures in the manner described in the aforesaid U.S. Pat. No. 3,958,756. Lugs 126 extend outwardly from the periphery of director 120 to seat within slots 128 formed in correspondence with slots 50 so that director 120 is correctly oriented when assembled. A shelf 130 formed on the internal wall of housing 32 accommodates a resilient O-ring 132 disposed beneath an overhang 134 on director 120, so as to effect a further degree of sealing. Projecting rearwardly from director 120 are a pair of space-opposed posts 140 the rearward ends of which, upon assembly, are engaged by the undersurface of connector 36 in order to create sealing pressure upon gasket 122 and seal 132.

Seated immediately to the rear of director 120 is a control plate 142. It includes a rearwardly-turned peripheral margin 144 that faces a forwardly-directed annulus 146 on connector 36 which restrains control plate 142 in position against director 120. A ring gear 150 is defined on the radially-inward surface of peripheral portion 144 and mates with a spur gear formed on one end of a shaft 152 that projects rearwardly through connector 36 alongside tube 40. An O-ring 154 is seated on shaft 152 so as to establish a rotational seal between that shaft and the wall of connector 36.

Encircling and essentially riding around the entire assembly is a control ring 160. It includes a forwardly-facing series of flutes 161 for grasping by the fingers of the user to orient rotation of ring 160 relative to decal 88. The rotational position is indicated by a radial ear 162. A skirt 163 depends rearwardly and is then bent inwardly to define a bearing 164 ensleeved upon a surface 166 presented by tube 40 outwardly of connector 36.

Seated snugly more to the rear of ring 160 is a base cone 168 which mates at one end with skirt 163 and from its other end includes an inwardly projecting boss 170 internally threaded to mate with tube 40 at threads 42. A ring gear 172, formed within control ring skirt 162, mates with a spur gear 174 attached on the rearward end of shaft 152, so as to drive the latter in rotation and thereby rotate control plate 142 about the longitudinal axis 176 of the entire unit.

A well, formed on the internal periphery of the rearward end or tube 40, accommodates a seal 177. A preferably included mesh screen 178 is seated just forwardly of seal 177, the internal conformation of tube 40 accepting that orientation. The other end portion 180 of boss 170 is conformed to the more-rearward portion of a spherical pivot ball 182 which mounts the entire showerhead 30. As shown, the rearward end portion of tube 40 also is conformed to seat on ball 182 and be sealed thereto by means of seal 177.

Returning to a discussion of cup 44, it includes the formation of space-opposed passages 190 and 192 which lead from director 120 directly to channels 60. When water is emitted through those passages, a continuous spray is outletted through the orifices defined by channels 60 and seal 66 for the purpose of emitting a continuous spray. A boss 184 on the forward surface of director 120 has an interference fit on the rearward end of tube 68, so that director 120 is seated in place frictionally in sealing engagement with tube 68 and held in position by force induced in posts 140. Similarly held in position is a circular rib 194 which seats inside of the continuous inner wall of troughs 110 and 112 and passages 190 and 192. Rib 194 assists in retaining gasket 122 in place.

With the exception of a few but significant details yet to be discussed in more depth, the arrangement so far described implements the principles taught in the aforementioned U.S. Pat. Nos. 3,801,019, 3,762,648 and 3,958,756, as augmented by the disclosure in application Ser. No. 794,958, filed May 9, 1977, with regard to the inclusion of and the selection as between the use of such as central orifices 78. Additional features as described in application Ser. No. 913,284, filed June 7, 1978, have been included as representing the presently-best-known mode of implementing the current invention. In particular, the present invention seeks to implement selection as to the degree of pulse perception sensed by the user as described in said application Ser. No. 794,958. Accordingly, all of those patents and applications are incorporated herein by reference and made a part hereof. On the other hand, and specifically with respect to showerhead 30, important distinctions are hereinafter to be described, particularly with relation to the operation of nozzles 114, 116 and 118 and their cooperation with director 120 and control plate 142.

Director plate 120 includes apertures 200 and 202 respectively aligned with passages 190 and 192 so as to communicate water to channels 60. A somewhat centrally located aperture 204 is aligned to emit water into tube 68 so as to outlet through orifices 78. Oriented to discharge directly into chamber 52, and thus to "spoil" the speed of rotation of turbine 90, is an aperture 206 which admits water directly into the path of rotation of turbine 90 so as to slow down its speed of rotation. On one marginal portion of director 120 is an aperture 208 that communicates to trough or plenum 112. Near the opposite margin of director 120 are a pair of circumferentially-spaced apertures 210 and 212 that communicate with trough or plenum 110. Troughs 110 and 112 are each sealed, so as to be independent of one another.

Control plate 142 overlies all of the apertures just described and includes shutter blades 220, 222, 224 and 226. Extending from blade 222 toward but spaced from blade 220 is a web 228, and a similar web 230 extends from blade 222 toward blade 224. Similarly, there is a web 232 which extends from blade 226 toward but spaced from blade 224 and a web 234 that extends from blade 226 toward blade 220. This combination of webs and blades define openings 236, 238, 240 and 242, as well as openings 244 and 246 which accommodate posts 140. Each of the apertures in plate 120 takes the form of a well that includes an O-ring 248, engageable with a corresponding surface on control plate 142, in the manner described in said U.S. Pat. No. 3,958,756 for the purpose of achieving a satisfactory seal between the director and the overlying portion of the control plate.

Openings 236, 238, 240 and 242 are aligned with apertures 200, 202, 208, 210 and 212. Situated radially inside openings 244 and 246 are a spaced-opposed pair of openings 250 and 252 that are radially aligned with aperture 204. Disposed radially outward from openings 244 and 246 are a respective pair of space-opposed openings 254 and 256 that are radially aligned with aperture 206. As will be appreciated after further description, a degree of redundancy has been included in control plate 142 in order to accommodate its being assembled in either of two possible orientations. That is, only one of openings 250 and 252 and only one of openings 254 and 256 become functional when the unit is finally assembled.

It is intended that the user manipulate control ring 160 so as, through shaft 152, to rotate control plate 142 relative to director 120 in a manner that achieves selection of the flow of water as between different ones of the apertures in the director. These differences in relative rotational relationships are illustrated in FIGS. 9A through 9F.

Figure 9A:
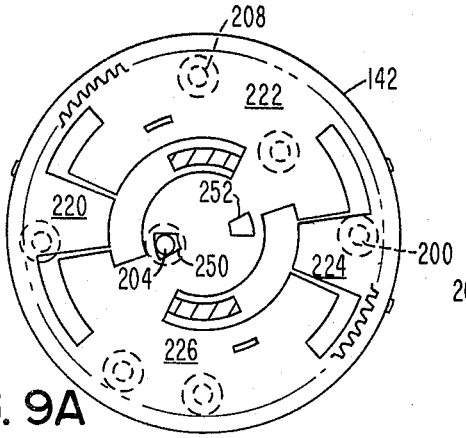
FIGS. 9A–9F are diagrammatic views showing relative adjustment of components in the assembly of FIG. 6 during different modes of operation.
Figure 9B:
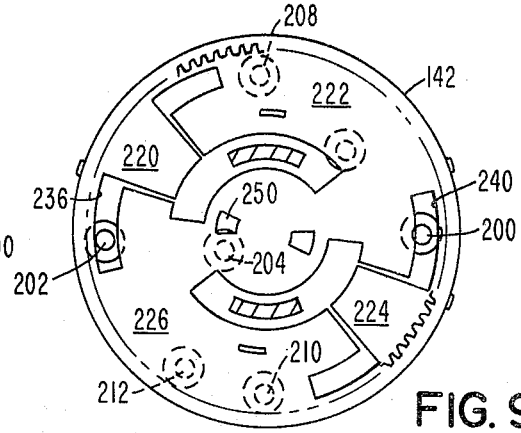

As shown in FIG. 9A, one extreme rotational position as between director 120 and plate 142 results in the flow of water only from opening 250 (or 252) through aperture 204 so as to cause the emission of a soft central spray from apertures 78. All other apertures are blocked by the shutters and webs. When plate 142 is rotated to the position shown in FIG. 9B, apertures 200 and 202 are enabled to feed water to the outer spray discharged from channels 60 and aperture 204 is closed as are all other apertures. Intermediate the positions of FIGS. 9A and 9B, there is a combination of the central and outer sprays.

Figure 9C:
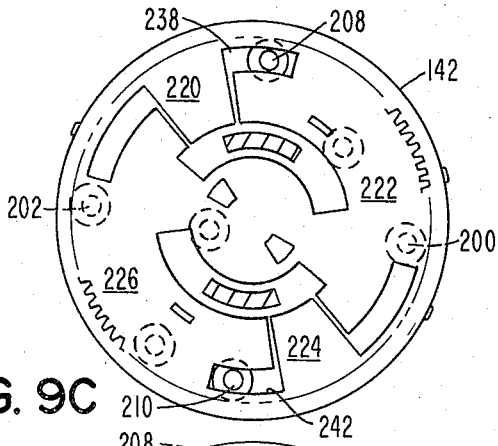

Continuing with rotation in the same direction of plate 142 to the position shown in FIG. 9C, apertures 208 and 210 admit the flow of water only into troughs 110 and 112 so as to drive turbine 90 and produce a pulsating spray through orifices 54. That spray is in the form of a fast hard pulse, because a maximum flow of water is admitted through orifices 54 by reason of the utilization of both of troughs 110 and 112. Intermediate the positions of FIGS. 9B and 9C, there is the emission of a combination of outer spray from channels 60 and fast comparative-hard pulses from orifices 54.

Figure 9D:
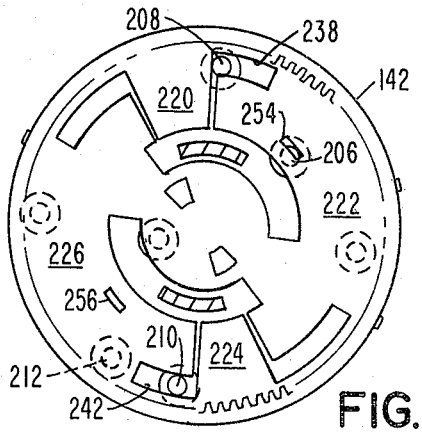

When control plate 142 is further rotated to the position of FIG. 9D, apertures 208 and 210 remain open but one of openings 254 and 256 uncovers aperture 206. As the latter is uncovered, that serves to slow down the speed of pulsation by reason of the spoiling effect of the direct flow into the path of turbine 90. Thus, FIG. 9D represents a condition for the emission of hard but slow pulses from orifices 54.

Figure 9E:
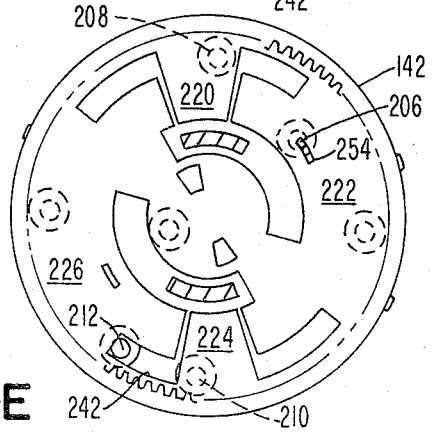

With still further rotation of control plate 142 toward the position of FIG. 9E, aperture 210 begins to be covered as aperture 212 begins to be opened, the amount of closing of aperture 210 being proportional to the amount of opening of aperture 212. Thus, the flow of water delivered through nozzle 114 stays the same. On the other hand, the flow of water delivered through nozzles 116 and 118 is being reduced as aperture 208 is progressively being closed by the interposition thereover of one of blades 220 or 224. In the position of FIG. 9E, apertures 206 and 212 are uncovered, but aperture 208 is closed. As a result of terminating flow into plenum 112 and through nozzles 116 and 118, the showerhead delivers only soft and slow pulses through orifices 54.

Figure 9F:
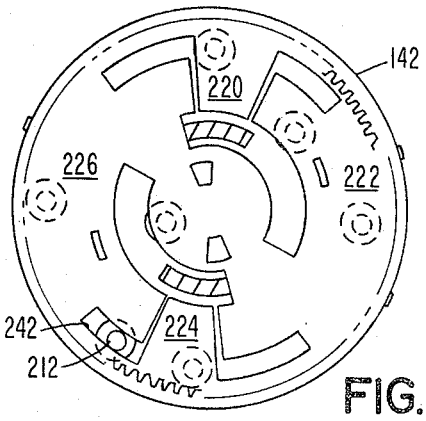
Figure 10:
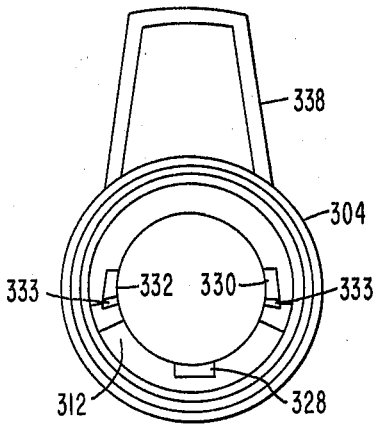
FIG. 10 is a view of one component shown in FIGS. 1–3.
Figure 11:
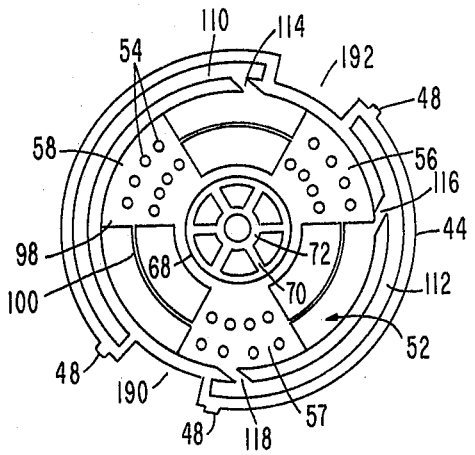
FIG. 11 is a view of another component shown in FIGS. 5 and 6.

Finally, further rotation to the position of FIG. 9F causes the one of openings 254 and 256 being used to again close aperture 206 and only aperture 212 is uncovered. That causes the speed of pulsation to return to a fast condition. Because the entire flow is restricted to aperture 212, however, these fast pulses exhibit a soft force.

In the particular embodiment disclosed, control of the rate of pulsation is by means of the sizes assigned to nozzles 114, 116 and 118. Alternatively, the ultimate forces could be controlled by selection of the sizes of apertures 208, 210 and 212. In any case, the development of a hard pulsating effect as delivered from orifices 54 requires that water be delivered to both of troughs 110 and 112. On the other hand, one of nozzles 116 and 118 may be eliminated, provided that the other is made comparatively larger so as to prevent turbine 90 from rotating excessively fast.

In the preferred embodiment, turbine 90 rotates at a speed of between 3400 and 3800 revolutions per minute when in the fast-pulse mode. As water is fully emitted through aperture 206 in order to achieve slow pulsation, the speed of turbine 90 preferably is between 900 and 1200 revolutions per minute. At a delivery pressure of 30 pounds per square inch, the unit delivers approximately 3.7 gallons per minute when in the hard-pulse mode and about 2.0 gallons per minute in the soft-pulse mode.

Both of troughs 110 and 112 are preferably included, so as to enable obtaining the desired range of speed while yet being able to change the amount of total water flow in order to vary output force and, hence, perception of the pulses as sensed on the skin of the user. To these ends, nozzles 114, 116 and 118 and the sizes of apertures 208, 210 and 212 all are selected so as to enable a change from hard to soft pulsating delivery without any significant degree of change in speed of turbine 90. Thus, the sizes of troughs 110 and 112 as combined with apertures 208, 210 and 212 is sufficient to enable adjustment of flow rate of the water ultimately emitted from orifices 54, leaving it to the additional element of control afforded by the emission of water through aperture 206 to vary the speed of pulsation.

It will be observed that manipulation of the single control member 160 enables selection as between three different kinds of spray, speed of pulsation of one mode of spray and degree of pulse perception in that latter mode of spray. The user has the choice between message action by pulses that range from fast and hard through slow but hard and slow but soft to fast but soft. On the other hand, the manner of construction follows directly from earlier showerheads, as described in the herein incorporated references, that already have proved to be highly successful. In terms of the total number of principal components involved for producing the new showerhead, the count remains the same as before. Nevertheless, the differences herein described afford a much greater flexibility in performance characteristics.

As particularly shown, the combination of each shutter blade or web of plate 142 and the associated aperture in director 120 is a valve. The best mode of implementation, as shown, incorporates all apertures in a single director and all shutters in a single plate. However, separate but associated valving may be substituted. For example, one alternative has aperture 204, which supplies water to the central spray, serve as a seat for a discshaped valve that is centrally disposed in an opening through control plate 142. The valve is mechanically coupled to plate 142, and one or more cams adjacent to that aperture serve to open the valve when water is to be fed to the central spray.

In this particular case, showerhead 30 is coupled through connecting ball 182 to a supply pipe 300. In itself, ball 182 is formed in accordance with the teachings of copending application Ser. No. 66,936, filed Aug. 16, 1979, now abandoned in favor of continuation-in-part application Ser. No. 146,456, filed May 5, 1980, by Elkins et al and assigned to the same assignee as the present application. Although other and well-known spherical balls may be employed, the one shown includes a top shell 301 of generally semi-hemispherical shape mated to a bottom shell 302 so as to form a connector that accommodates tube 42 and end portion 180 of boss 170. A tube 301*a* depends inwardly of top shell 301 and is in this case interference fit into the bore 302*a* of bottom shell 302.

External threads at 303 on ball 182 receive a sleeve 304 which is part of a misting device 305. Slidably received within sleeve 304 is a tube 306. At the rear end portion of tube 306 is a metal collar 308 threaded thereon and also threaded for attachment to pipe 300. Collar 308 is sealed to tube 306 by a washer 309. Collar 308 is not really necessary. However, it has been found to be desirable to include a metal part available for the home-user to apply to his inlet pipe 300 by use of a wrench. Actually, everything herein described could be installed by mere hand manipulation without the use of tools.

Figure 2:
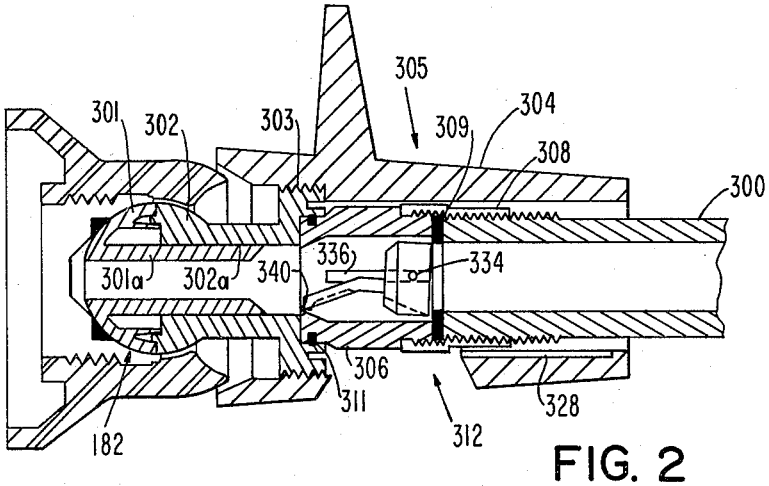
FIG. 2 is an enlarged cross-sectional view of a component assembly included in the system of FIG. 1.

At its forward end, toward ball 182, tube 306 is necked down and recessed to allow disposition of a resilient O-ring 311 which seats which the rearwardly-directed portion of the base of ball assembly 182 and completes a seal therewith. In the orientation illustrated in FIG. 2, therefore, water is permitted to flow from supply pipe 300, as a source, and be delivered through ball 182 into showerhead 30.

The assembly of tube 306 and sleeve 304 constitutes a conduit for delivering water from the source represented by pipe 300 toward showerhead 30. Disposed within that conduit is an assembly 310 for selectively diverting the water from the source away from showerhead 30 and through an outlet 312 defined in sleeve 306. As will be explained further, that diverted water is outletted in the form of a mist.

Figure 3:
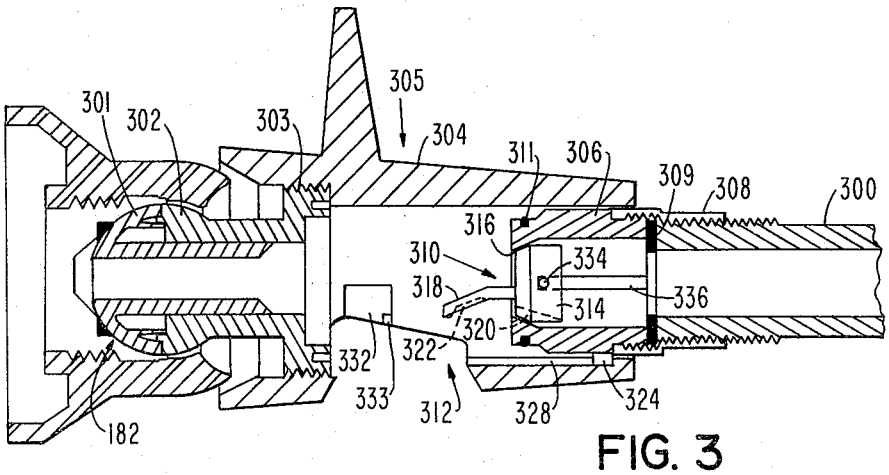
FIG. 3 is a view similar to FIG. 2 but with certain components in a different position.
Figure 4A:
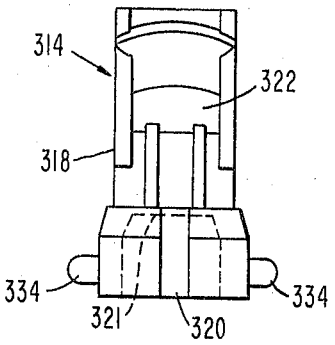
FIG. 4A is an enlarged bottom plan view of a component shown in FIGS. 2 and 3.
Figure 4B:
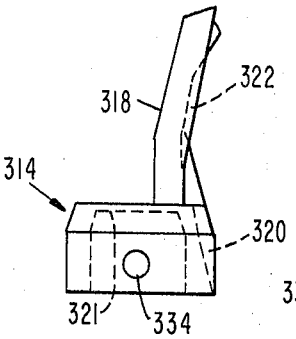
FIG. 4B is a side elevational view of the component shown in FIG. 4A.
Figure 4C:
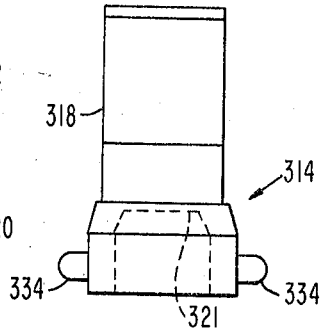
FIG. 4C is a top plan view of the component of FIGS. 4A and 4B.
Figure 5:
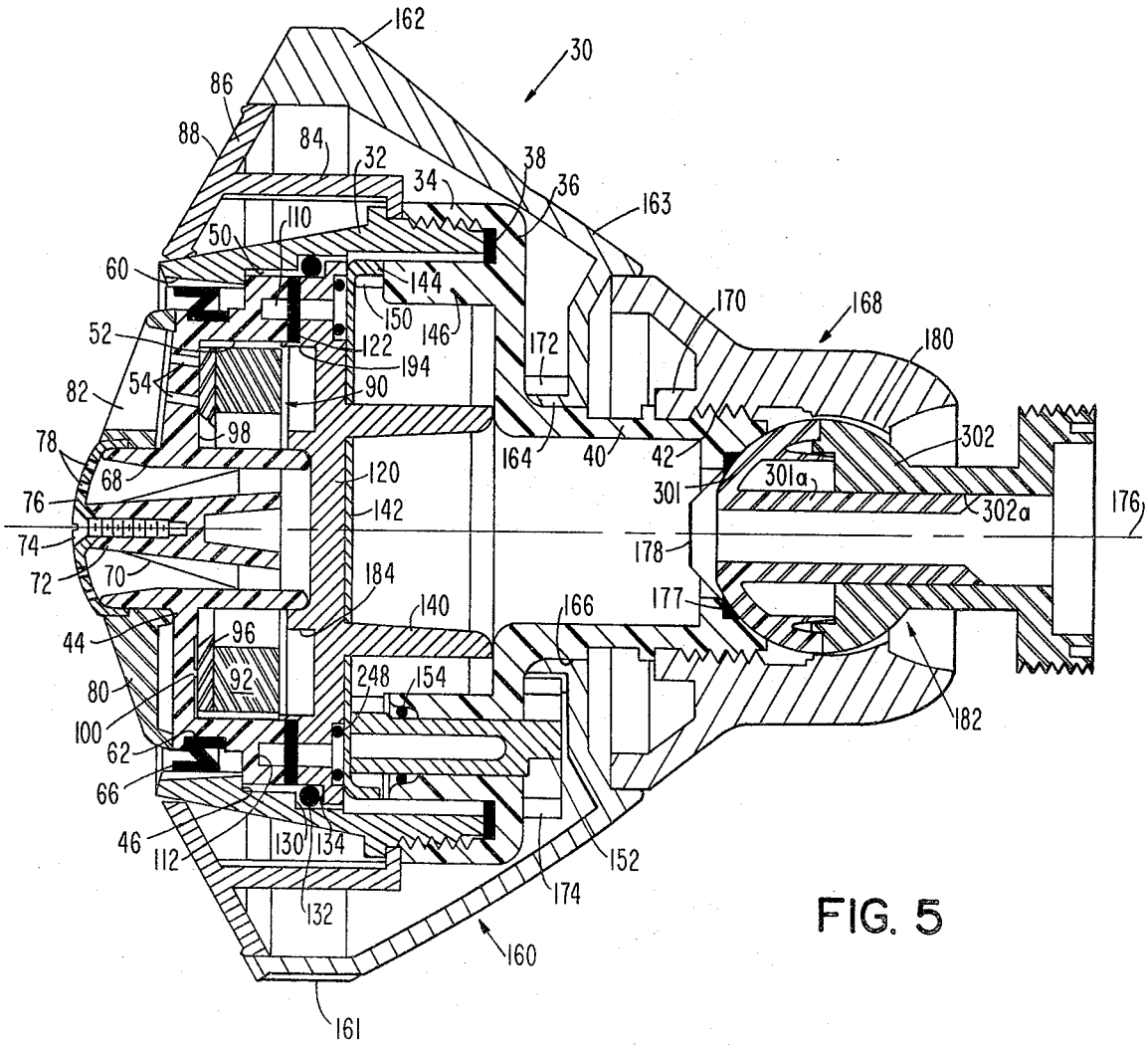
FIG. 5 is a longitudinal cross-sectional view through a showerhead included in FIG. 1.
Figure 6:
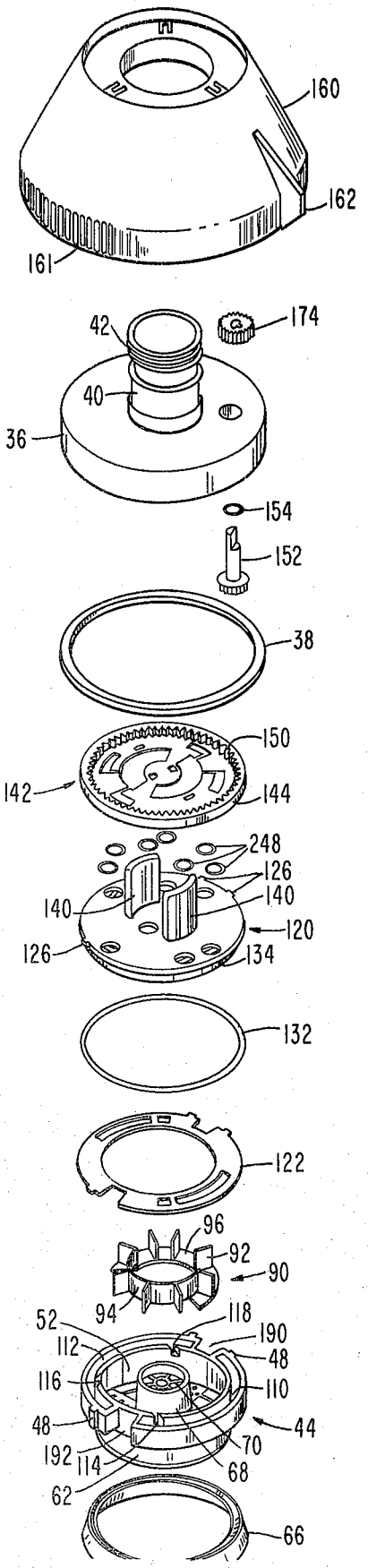
FIG. 6 is an exploded view of the showerhead assembly shown in FIG. 1.
Figure 6:
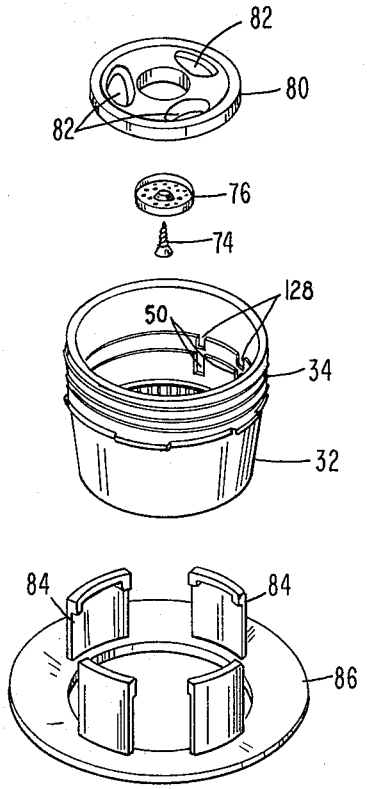
Figure 7:
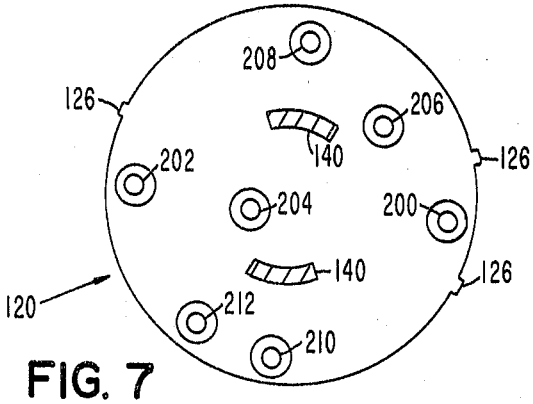
FIG. 7 is a plan view of a component shown in FIG. 6.
Figure 8:
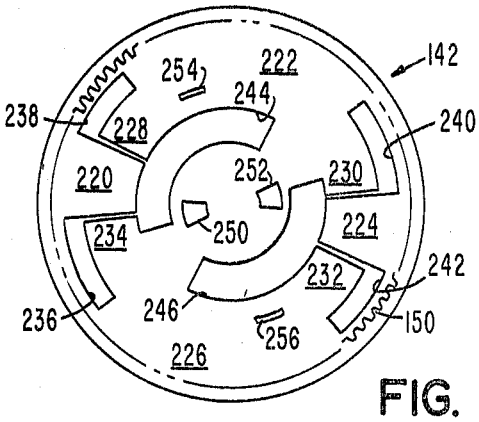
FIG. 8 is a plan view of another component shown in FIG. 6.

Associated with tube 306 is a valve 314 and a valve seat 316. Affixed to and projecting away from valve 314 is a deflector 318 that serves to cause the opening of valve 314 from seat 316 in order to allow water to pass around valve 314 and enter showerhead 30. On the other hand, valve 314 includes a by-pass orifice 320 that, when valve 314 is seated in engagement with seat 316, as shown in FIG. 3, permits water redirected from deflector 318 to be discharged through outlet 312. On its side facing pipe 300, valve 314 is cup-shaped to define a piston face 321. Water inletted from pipe 300 exerts substantial force against face 321, which has an area larger than that of orifice 320, so as to urge the valve strongly into a closed condition.

For the last-mentioned mode of operation, deflector 318 includes a pan 322 against which the incoming water impinges and is particlized. The shape of pan 322 is such that particles of the water are directed through outlet 312 in a generally oval-shaped cross-sectional pattern.

Included on tube 306 is a lug 324 that constitutes a key ridable within a keyway 328. Upon sliding movement of tube 306 relatively toward showerhead 30, lug 324 emerges from keyway 328 and, thereafter, may be locked into a seat within either one of notches 330 and 332, disposed interiorly of sleeve 304 in respective directions of rotational orientation. Each notch includes a shoulder 333 beyond which lug 324 may be seated. When sleeve 304 is moved rearwardly on tube 306, to the position shown in FIG. 2, deflector 318 is pushed to the rear, so as to move its integrally associated valve 314 also rearwardly as its laterally-projecting pivot pins 334 ride in longitudinal channels 336 cut into the inner wall of tube 306. A tab 338, projecting laterally outward from sleeve 304, assists the user in moving sleeve 304 over tube 306.

It will be seen that valve 314 is a part of an assembly that, when the water is being diverted through outlet 312, is substantially biased against the selection of water flow to showerhead 30. That degree of bias occurs automatically in response to the flow of water into the conduit assembly. Orifice 320 is what may be called self-flushing. That is, when valve 314 is opened, the flow of water to showerhead 30 serves to clean orifice 320.

Guide channels 336 serve to maintain valve 314 in an appropriate position at all times. When tube 306 is so moved with respect to sleeve 304 as to close opening 312 as in FIG. 2, valve 314 is pushed, by the result of abutment of deflector 318 against the interior 340 of the base of bottom shell 302 of ball 182, to an open position. The area of flow permitted around valve 314, in that condition, is fully sufficient to allow operation of showerhead 30.

On the other hand, when the assembly is in the position shown in FIG. 3, in which valve 314 is engaged with seat 316, deflector 318 is maintained in a very fixed position, so as to cause the flow of water conducted through orifice 320 to be discharged in the form of a mist. The force of water delivered through orifice 320 and against panshaped portion 322 is sufficient that it is extremely difficult for the user to push sleeve 304 backwardly into the "shower" position. The purpose of that is very consistent with the desire to use the hottest water temperature for development of the steam. It is not desired that the user be readily able to switch back to use of the showerhead while the water faucet assembly is adjusted to supply only hot water. Otherwise, the user could be scalded.

When deflector 318 is disposed in the operative position, and hot water is supplied thereto through orifice 320, the water is particlized or atomized into an extremely fine mist. That mist is directed downwardly alongside the wall of a showerstall. By the time the mist reaches the bottom, it is cool enough to be safe for reception on the skin of a user. On the other hand, the hydraulic force of the flow of the mist is sufficient to entrain outside air which assists in producing steam that rises upwardly toward the showerhead. As a result, no confining apparatus is needed to convert a showerstall into a sauna. If desired, however, a shroud may be installed over the usual plastic, glass or plastic sheet enclosure around a showerstall or tub unit. Such a shroud may be affixed to the ceiling and allowed to depend downwardly over the more-normal upper edge portions of the stall or other enclosure.

Figure 12:
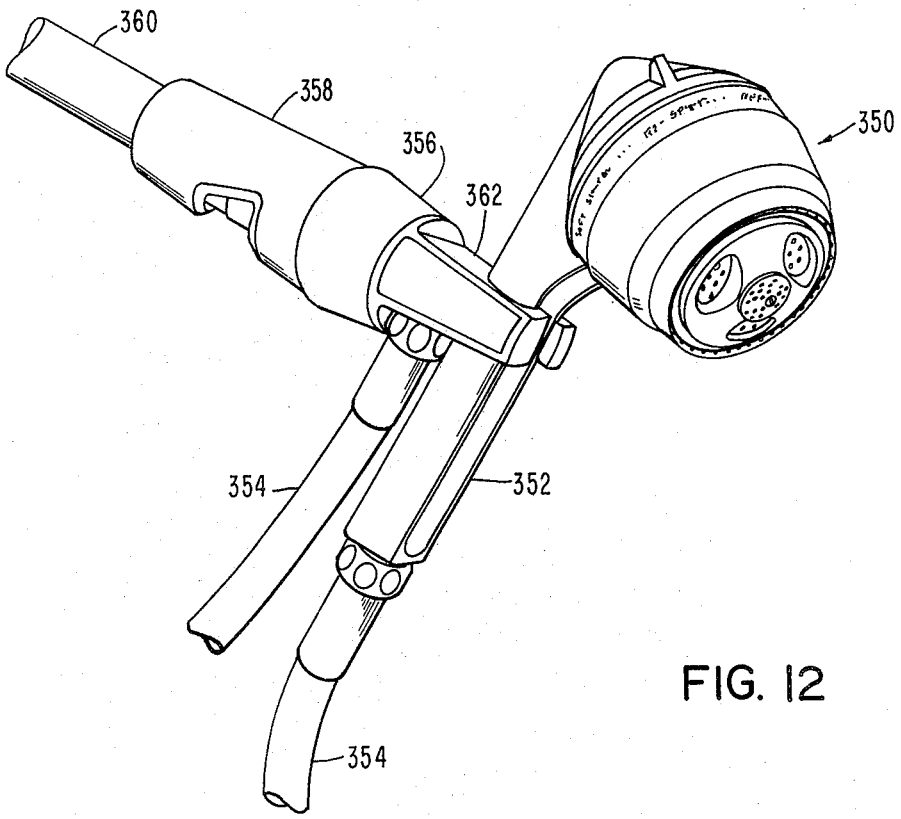
FIG. 12 is an isometric view of another embodiment of a showering system which includes components similar to those shown in FIGS. 2–7.

Several of the predecessor showerheads, as described in the incorporated references, have been offered both in a wall-mounted unit or in a hand-held model. As so far discussed, the unit of FIG. 1 is a well-mounted unit. FIG. 12 illustrates its adaptation as a hand-held unit. The structure and manner of operation of the essential components remains the same. That is, showerhead 350 is basically like showerhead 30 except for the provision of a laterally projecting handle 352 through which the water from a hose 354 is admitted. Hose 354 connects through an adaptor 356 to a misting device 358 mounted on a supply pipe 360. Here again, the structure and manner of operation of device 358 is the same as device 305 in all essential respects. Only certain exterior shaping, as shown, is changed to conform better with the different mode of mounting. A bracket 362, mounted on adaptor 356, secures showerhead 350 in a storage or fixed-delivery position. Detachment of showerhead 350 from bracket 362 permits the user to direct the various spray patterns and modes as desired.

What has been presented herein is a combination unit that enables enjoyment by the user of sauna steam followed by, or interspersed with, the application to the body of the user of a pulsating spray for massage action. As separated from the overall concept, the disclosed showerhead has its own advantages in presenting a unicontrol operation of pulse perception variation, pulse speed and a combination of different spray patterns, while the misting device herein disclosed is appropriate for adaptation to usage not only with the showerhead specifically shown but also with many others.

For use of showerhead 30 without misting device 305, the base of ball 182 preferably is internally threaded, so as to fit directly onto pipe 300. Alternatively, of course, a suitable fixed coupling may be used to connect the illustrated form of base to a supply pipe. To use misting device 305 with a different showerhead, a suitable fixed coupling similarly may be supplied. When, as usual, that different showerhead has a fitting matable with supply pipe 300, a reducing nipple is provided and has one set of threads engageable at 303 and another set of threads to mate with those on the supply pipe.

While particular embodiments of the invention have been shown and described, and alternatives and modifications have been mentioned, it will be obvious to those skilled in the art that changes and further modifications may be made without departing from the invention in its broader aspects. Therefore, the aim in the appended claims is to cover all such changes and modifications as fall within the true spirit and scope of that which is patentable.

We claim:

1. In a showering system including a source of hot water and a showerhead fed from said source, a steam producer comprising:

a conduit for delivering water from said source toward said showerhead;

an outlet defined in said conduit;

and means disposed in said conduit for selectively diverting the water from said source away from said showerhead and through said outlet in the form of a mist.

2. A system as defined in claim 1 in which said diverting means includes a manually operable valve assembly that, when said water is being diverted through said outlet, is substantially biased against selection of water flow to said showerhead.

3. A system as defined in claim 2 in which said valve assembly automatically is biased in response to the flow of said water into said conduit.

4. A system as defined in claim 1 in which said diverting means includes:

a valve;

a valve seat;

and means for opening said valve from said seat and directing water from said source to said showerhead and for closing said valve to said seat and directing water from said source through said outlet.

5. In a showering system including a source of hot water and a showerhead fed from said source, a steam producer comprising:

a conduit for delivering water from said source toward said showerhead;

an outlet defined in said conduit;

means disposed in said conduit for selectively diverting the water from said source away from said showerhead and through said outlet in the form of a mist;

said diverting means further including:

a valve;

a valve seat;

means for opening said valve from said seat and directing water from said source to said showerhead and for closing said valve to said seat and directing water from said source through said outlet;

and an orifice defined between said valve and valve seat for passage of said water from said source through said outlet when said valve is closed to said seat.

6. A system as defined in claim 5 in which said orifice is disposed in a position to be flushed by flow of said water from said source to said showerhead when said valve is opened from said seat.

7. A system as defined in claim 5 or 6 in which said orifice is defined by a channel formed into the surface of said valve that mates with said seat.

8. A system as defined in claim 1 in which said diverting means includes a deflector disposed in the path of water flowing from said source toward said showerhead and oriented to direct said water through said outlet.

9. In a showering system including a source of hot water and a showerhead fed from said source, a steam producer comprising:

a conduit for delivering water from said source toward said showerhead;

an outlet defined in said conduit;

means disposed in said conduit for selectively diverting the water from said source away from said showerhead and through said outlet in the form of a mist;

said diverting means including a deflector disposed in the path of water flowing from said source toward said showerhead and oriented to direct said water through said outlet;

said deflector being movable within said conduit, and which includes means for maintaining said deflector in an orientation facing said outlet when directing said water therethrough.

10. A system as defined in claim 8 in which said deflector includes a pan against which said water impinges and is particlized.

11. A system as defined in claim 10 in which said pan is shaped to direct particles of said water through said outlet opening in a generally oval-shaped cross-sectional pattern.

12. In a showering system including a source of hot water and a showerhead fed from said source, a steam producer comprising:

a conduit for delivering water from said source toward said showerhead;

an outlet defined in said conduit;

means disposed in said conduit for selectively diverting the water from said source away from said showerhead and through said outlet in the form of a mist;

said diverting means including a deflector disposed in the path of water flowing from said source toward said showerhead and oriented to direct said water through said outlet.

a valve;

a valve seat;

means for opening said valve from said seat and directing water from said source to said showerhead and for closing said valve to said seat and directing water from said source through said outlet;

and in which said deflector is affixed to and projects away from said valve.

13. A system as defined in claim 12 which includes means for guiding movement of said valve and maintaining said valve and said deflector in a fixed orientation when said water is being directed through said outlet.

14. A system as defined in claim 12 in which said valve, when engaged in said valve seat, holds said deflector rigidly in position to direct said water through said outlet.

15. A system as defined in claim 12 which further includes means for affirmatively holding said valve away from said valve seat while enabling flow of said water into said showerhead.

16. A system as defined in claim 12 which further includes an orifice defined between said valve and said valve seat for directing a stream of water against said deflector when said valve is engaged with said valve seat.

17. A system as defined in claim 16 in which said valve includes a piston face against which water incoming from said source exerts force in a direction closing said valve with said valve seat.

18. A system as defined in claim 4 in which said conduit further includes:

a tube within which said valve and valve seat are disposed with said valve being movable therein and sized to accommodate flow therearound of water from said source to said showerhead when said valve is open from said valve seat.

19. In a showering system including a source of hot water and a showerhead fed from said source, a steam producer comprising:

a conduit for delivering water from said source toward said showerhead;

an outlet defined in said conduit;

means disposed in said conduit for selectively diverting the water from said source away from said showerhead and through said outlet in the form of a mist;

a valve;

a valve seat;

means for opening said valve from said seat and directing water from said source to said showerhead and for closing said valve to said seat and directing water from said source through said outlet;

a tube within which said valve and valve seat are disposed with said valve being movable therein and sized to accommodate flow therearound of water from said source to said showerhead when said valve is open from said valve seat;

and means for mounting said valve for longitudinal but non-rotational movement within said tube.

20. A system as defined in claim 19 in which said mounting means includes a pivot enabling tilting of said valve with respect to the direction of said movement.

21. A system as defined in claim 20 in which said diverting means further includes a deflector affixed to and projecting away from said valve, and in which said valve engages said valve seat in a fixed orientation to hold said deflector in the path of water flowing from said source and in a position to direct said water through said outlet.

22. In a showering system including a source of hot water and a showerhead fed from said source, a steam producer comprising:

a conduit for delivering water from said source toward said showerhead;

an outlet defined in said conduit;

means disposed in said conduit for selectively diverting the water from said source away from said showerhead and through said outlet in the form of a mist;

a sleeve in which said outlet is defined;

a tube over and relative to which said sleeve is slidable between a first position in which said tube closes said outlet and a second position in which said outlet is exposed;

and means effecting a seal between said sleeve and said tube when said sleeve is disposed in said first position.

23. A system as defined in claim 22 in which said sleeve includes means coupled to said showerhead and said tube includes means coupled to said source.

24. A system as defined in claim 22 which includes means for locating said sleeve in a predetermined rotational orientation relative to said tube when said sleeve is in said second position.

25. A system as defined in claim 22 which includes means for locking said sleeve relative to said tube when said sleeve is in said first position.

26. A system as defined in claim 22 which includes means for locating said sleeve in a predetermined rotational orientation relative to said tube when said sleeve is in said second position and for locking said sleeve relative to said tube when said sleeve is in said first position and in a different relative rotational orientation than said predetermined orientation.

27. A system as defined in claim 26 in which said locking means selectively secures said sleeve relative to said tube in respective rotational orientations in each direction from said predetermined orientation.

28. A system as defined in claim 22 which includes a keyway disposed longitudinally on one of said sleeve and said tube and a key slidable in said keyway and disposed on the other of said sleeve and said tube, said key being receivable in said keyway to locate said sleeve relative to said tube when said sleeve is in said second position.

29. A system as defined in claim 28 which further includes a slot disposed in said one of said sleeve and said tube, and in which said key is movable into said slot to lock said sleeve in said first position.

30. A system as defined in claim 22 in which said diverting means includes a valve operable in response to movement of said sleeve relative to said tube.

31. A system as defined in claim 30 in which said valve includes a piston face against which water incoming from said source exerts substantial force in a direction urging said valve against said valve seat.

32. A system as defined in claim 31 which includes push means movable with said sleeve for urging said valve away from said valve seat, and in which said force is sufficient to substantially resist manual movement of said sleeve and said push means.

33. A system as defined in claim 32 in which said push means is a deflector disposed in the path of water flowing from said source toward said showerhead and oriented to direct said water through said outlet.

34. A system as defined in claim 30 in which said diverting means includes a deflector of water directed through said outlet, in which said deflector is affixed to and projects away from said valve, in which an abutment is included in said conduit, and in which said valve is operated in response to engagement of said deflector with said abutment upon movement of said sleeve to said first position.

35. A system as defined in claim 22 which includes a hollow coupling between said sleeve and said showerhead, and in which said seal is effected by a resilient element mounted on said tube and received within said coupling.

36. A system as defined in claim 1 in which said outlet faces in a downward direction, and in which said mist is discharged from said outlet in a general direction that is vertically downward.

37. A system as defined in claim 1 in which said diverting means includes an orifice for the flow of said water, and in which said orifice is disposed in a position to be flushed by flow of said water from said source when delivered into said showerhead.

38. In a showering system including a source of hot water and a showerhead fed from said source, a steam producer comprising:

a conduit for delivering water from said source toward said showerhead;

an outlet defined in said conduit;

means disposed in said conduit for selectively diverting the water from said source away from said showerhead and through said outlet in the form of a mist;

and said showerhead having an inlet, a series of circumferentially-spaced orifices, a turbine with a valve for sequentially opening successive ones of said orifices, a plurality of nozzles for driving said turbine, a multiple-apertured flow director plate for communicating water from said inlet to said nozzles, a control plate for selectively coupling water from said inlet to different ones of said apertures, and a control for moving said control plate relative to said director plate.

39. In a showerhead that has an inlet, a series of circumferentially-spaced orifices, a turbine with a valve for sequentially opening successive ones of said orifices, a plurality of nozzles for driving said turbine, a multiple-apertured flow director plate for communicating water from said inlet to said nozzles, a control plate for selectively coupling water from said inlet to different ones of said apertures, and a control for moving said control plate relative to said director plate, the improvement comprising:

at least first and second independent ones of said nozzles;

at least first and second apertures associated with said director plate;

and shutters associated with said control plate for selectively opening said apertures in different combination, the flow capacities of said nozzles being predetermined to vary the force of water delivered from said orifices in correspondence with the number of said nozzles opened to communication with said inlet through said apertures.

40. A showerhead as defined in claim 39 in which said nozzles extend from a common plenum into which water is fed through said apertures.

41. A showerhead as defined in claim 39 which further includes a third one of said apertures associated with said director plate, and in which said shutters selectively open all three of said apertures.

42. A showerhead as defined in claim 41 in which said shutters are disposed to enable opening said second aperture commensurate with closing of said third aperture.

43. A showerhead as defined in claim 41 in which two of said nozzles extend from a first plenum and a third one of said nozzles extends from a second plenum separate from said first plenum.

44. A showerhead as defined in claim 43 in which said shutters and apertures are disposed to enable feeding water simultaneously to one of said two nozzles and said third nozzle.

45. In a showerhead that has an inlet, a series of circumferentially-spaced orifices, a turbine with a valve for sequentially opening successive ones of said orifices, a plurality of nozzles for driving said turbine, a multiple-apertured flow director plate for communicating water from said inlet to said nozzles, a control plate for selectively coupling water from said inlet to different ones of said apertures, and a control for moving said control plate relative to said director plate, the improvement comprising:

at least first and second independent ones of said nozzles;

at least first and second apertures associated with said director plate;

shutters associated with said control plate for selectively opening said apertures in different combination, the flow capacities of said nozzles being predetermined to vary the force of water delivered from said orifices in correspondence with the number of said nozzles opened to communication with said inlet through said apertures;

a third one of said apertures associated with said director plate, and said shutters selectively opening all three of said apertures;

two of said nozzles extending from a first plenum and a third one of said nozzles extending from a second plenum separate from said first plenum;

said shutters and apertures being disposed to enable feeding water simultaneously to one of said two nozzles and said third nozzle;

and said shutters and apertures being disposed to enable feeding the other of said two nozzles as said one is closed.

46. A showerhead as defined in claim 45 in which said shutters and apertures further are disposed to enable feeding only said other nozzle.

47. A showerhead as defined in claim 39 in which said turbine is confined within a vortex chamber, and in which each of said nozzles opens only into a limited extent of the depth of said chamber.

48. A showerhead as defined in claim 39 which further includes another aperture associated with said director plate aligned to admit water into the path of rotation of said turbine, and in which said shutters also are formed to selectively admit water through said other aperture.

49. A showerhead as defined in claim 48 in which said control plate includes an opening aligned to admit water into said other aperture selectively in coordination with selective opening of said first and second apertures.

50. A showerhead as defined in claim 39 in which said showerhead additionally includes first means for discharging a continuous spray of water, said director plate includes at least one additional aperture communicating with said first means, and said control plate includes shutter elements disposed for opening of said additional aperture selectively in coordination with selective opening of said first and second apertures.

51. In a showerhead that has an inlet, a series of circumferentially-spaced orifices, a turbine with a valve for sequentially opening successive ones of said orifices, a plurality of nozzles for driving said turbine, a multiple-apertured flow director plate for communicating water from said inlet to said nozzles, a control plate for selectively coupling water from said inlet to different ones of said apertures, and a control for moving said control plate relative to said director plate, the improvement comprising:

at least first and second independent ones of said nozzles;

at least first and second apertures associated with said director plates;

shutters associated with said control plate for selectively opening said apertures in different combination, the flow capacities of said nozzles being predetermined to vary the force of water delivered from said orifices in correspondence with the number of said nozzles opened to communication with said inlet through said apertures;

first means for discharging a continuous spray of water, said director plate including at least one additional aperture communicating with said first means, and said control plate including shutter elements disposed for opening of said additional aperture selectively in coordination with selective opening of said first and second apertures;

and second means, disposed within said first means and said orifices, for emitting a continuous spray of water, said director plate including a further aperture communicating with said second means, and said control plate including shutter elements disposed for selective opening of said further aperture selectively in correspondence with selective opening of said first, second and additional openings.

52. A showerhead as defined in claim 50 in which said control plate enables selection as between outlet only from said first means, outlet from said first means in combination with a hard force of water delivered from said orifices at a fast rate of pulsation, outlet only from said orifices with a hard force at a fast rate, outlet only from said orifices at a slow rate and with a hard force, outlet from said orifices at a slow rate and with a soft force and outlet from said orifices at a fast rate and with a soft force.

53. A showerhead as defined in claim 39 in which all of said shutters are disposed on and are integral with said control plate.

54. In a showerhead that has an inlet, a series of circumferentially-spaced orifices, a turbine with a valve for sequentially opening successive ones of said orifices, a plurality of nozzles for driving said turbine, a multiple-apertured flow director plate for communicating water from said inlet to said nozzles, a control plate for selectively coupling water from said inlet to different ones of said apertures, and a control for moving said control plate relative to said director plate;

a cup in which said orifices are defined;

at least one plenum chamber defined in said cup and from which said nozzles extend;

a tube upstanding from said cup;

and a boss projecting outwardly from said director plate toward said cup, the outer end portion of said tube being coupled into said boss.

55. In a showerhead that has an inlet, a series of circumferentially-spaced orifices, a turbine with a valve for sequentially opening successive ones of said orifices, a plurality of nozzles for driving said turbine, a multiple-apertured flow director plate for communicating water from said inlet to said nozzles, a control plate for selectively coupling water from said inlet to different ones of said apertures, and a control for moving said control plate relative to said director plate:

a cup in which said orifices are defined;

at least one plenum chamber defined in said cup and from which said nozzles extend;

a tube upstanding from said cup;

a boss projecting outwardly from said director plate toward said cup, the outer end portion of said tube being coupled into said boss;

and said cup including a centrally disposed means for emitting a spray of water, said tube communicating with said emitting means, and said director plate and said control plate including means for selectively feeding water into said tube.

56. A showerhead as defined in claim 55 which includes means, disposed within said tube, for dispersing water to said centrally-disposed means that is received in a confined stream through said director plate.

57. A showerhead as defined in claim 54 in which said tube and said boss respectively are sized to an interference fit that allows frictional sealing of said director plate to said cup.

* * * * *